US005403690A

United States Patent [19]

Kuramoto et al.

[11] Patent Number: 5,403,690

[45] Date of Patent: Apr. 4, 1995

[54] DEVELOPER FOR DEVELOPING LATENT ELECTROSTATIC IMAGES

[75] Inventors: Shinichi Kuramoto; Yasuo Asahina; Michio Izumi, all of Numazu; Yoshihisa Okamoto, Fuji; Hiroaki Matsuda, Numazu; Hidefumi Gohhara, Numazu; Chiharu Mochizuki, Numazu; Tomomi Suzuki, Gotemba, all of Japan

[73] Assignee: Ricoh Company, Ltd., Tokyo, Japan

[21] Appl. No.: 219,522

[22] Filed: Mar. 29, 1994

[30] Foreign Application Priority Data

Mar. 31, 1993 [JP] Japan ..... 5-096778

[51] Int. Cl.[6] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 5,069,994 | 12/1991 | Gitzel et al. | 430/110 |
| 5,215,850 | 6/1993 | Tsubota et al. | 430/110 |
| 5,300,387 | 4/1994 | Ong | 430/110 |

*Primary Examiner*—Roland Martin
*Attorney, Agent, or Firm*—Cooper & Dunham

[57] ABSTRACT

A developer is composed of toner particles which contain a thermoplastic resin, a coloring agent, one component selected from the group consisting of a fluorine-containing quaternary ammonium salt compound and a fluorine-containing iminium compound, and an aromatic hydroxycarboxylic acid metallic salt.

This developer may also contain a carrier.

17 Claims, No Drawings

DEVELOPER FOR DEVELOPING LATENT ELECTROSTATIC IMAGES

BACKGROUND OF THE INVENTION

1. Field of the Invention

The present invention relates to a developer for developing latent electrostatic images for use in electrophotography, electrostatic printing and the like.

2. Discussion of Background

Two-component dry developers comprising carrier particles and toner particles have been conventionally known. In such a two-component dry developer, finely-divided toner particles are held on the surface of compartively large carrier particles by the electric force generated by the friction between the carrier particles and the toner particles. When the two-component dry developer is caused to come close to a latent electrostatic image, the attraction force generated between the toner particles and the latent electrostatic images overcomes the bonding force between the toner particles and the carrier particles, so that the toner particles are caused to be deposited on the latent electrostatic images. As a result, the latent electrostatic image is developed with the toner particles to a visible toner image. Therefore, the two-component dry developer is used as the toner particles are supplied thereto from time to time while in use in compensating for the toner particles used.

As the materials for a carrier for two-component dry developers, metallic oxides such as magnetite and ferrite are widely used. This is because such metallic oxides have a smaller apparent density than that of an iron powder carrier, so that when such metallic oxides are used as the materials for a carrier, the weight of the two-component dry developer can be reduced. Furthermore, such metallic oxides have an advantage over other materials that when such a metallic oxide is used as a carrier for a two-component dry developer, the stirring resistance of the two-component developer in a development unit is smaller than the stirring resistance of other materials employed in the carrier.

In addition, such metallic oxides have a smaller residual magnetic flux density and a smaller anti-magnetization force than those of an iron powder carrier, and accordingly have a smaller hysteresis loop area than that of an iron powder carrier. Furthermore, such metallic oxides have the characteristics that initial characteristics are always maintained against magnetic reversion and magnetization hysteresis.

Since magnetite and ferrite are oxides, they are chemically stable and hardly chemically changed in contact with ozone, $NO_x$ and the like, which are formed within a copying machine.

A carrier comprising an oxide such as ferrite or magnetite, however, has the shortcoming that a so-called spent phenomenon that a toner film is formed on the surface of carrier particles takes place by the heat generated while in use by the collision among developer particles during high speed development or during the process of making a number of copies, or by a mechanical collision between developer particles and members for a development unit while in use. Once such a spent phenomenon takes place, the charging performance of the carrier is decreased with time while in use. As a result, the toner particles are scattered and toner particles are deposited on the background of images.

In order to prevent the occurrence of such a spent phenomenon, methods of coating the surface of the core particles of carrier particles with a variety of resins have been proposed. However, none of them is satisfactory for use in practice. To be more specific, carrier particles coated with styrene-methacrylate resin or styrene polymer have excellent charging characteristics, but the critical surface tension thereof is relatively high, so that the above-mentioned spent phenomenon takes place during a repeated copy making operation and the life of the developer is shortened.

Examples of a conventional negative charge controlling agent include metal complex salts of monoazo dyes, nitrohumic acid and salts thereof, sulfonated copper phthalocyanine pigments, nitro-group- or chlorine-introduced styrene oligomers, chlorinate paraffin, and melamine resin. These compounds have a complicated structure, and therefore are unstable in the properties.

When such negative charge controlling agents are kneaded with application of heat thereto, they are easily decomposed and are caused to deteriorate, so that the charge controlling performance is lowered. Furthermore, the chargeability of many of such charge controlling agents is changed by the ambient conditions thereof.

There is a case where when a toner comprising such a conventional charge controlling agent is used for an extended period of time, the toner is deposited in the form of a film on a photoconductor because of its improper chargeability.

For instance, Japanese Laid-Open Patent Application 61-223753 discloses toners comprising aromatic hydroxy metallic salts such as a salicylic acid chromium complex. These toners, however, have the shortcomings that the chargeability is unstable, and the charging performance is greatly changed depending upon the ambient conditions thereof.

Japanese Laid-Open Patent Application 3-1162 discloses a method of using a fluorinated ammonium compound or iminium compound. However, when this method is employed, the charging stability differs depending upon a carrier employed, and it is difficult to obtain a sufficient charge-stabilizing effect on a non-coated carrier for use in practice by this method.

In the case of a styrene-acrylic copolymer coated carrier, the chargeability is stable in a continuous mixing process, but when it is repeatedly used with a toner being replenished in a development unit, the chargeability is unstable, and the initial charge-rising performance is not satisfactory for use in practice.

SUMMARY OF THE INVENTION

It is therefore a first object of the present invention to provide a developer capable of developing latent electrostatic images in a stable manner without being affected by the ambient conditions thereof such as temperature and humidity.

A second object of the present invention is to provide a two-component developer which is capable of providing developed images with high quality and faithfulness throughout a development process, with a high charge-rising performance, and has a stable triboelectric chargeability between toner particles and carrier particles, without causing the deposition of toner particles on the background of developed images and the scattering of the toner particles even when used continuously for an extended period of time.

A third object of the present invention is to provide a two-component color developer which is capable of providing uniform and high quality images free from edge effect, without the deterioration of color development performance even when used for an extended period of time.

The first object of the present invention is achieved by a developer comprising particles, which toner particles comprise a thermoplastic resin; a coloring agent; one component selected from the group consisting of a fluorine-containing quaternary ammonium salt compound and a fluorine-containing iminium compound; and an aromatic hydroxycarboxylic acid metallic salt.

It is preferable that the fluorine-containing quaternary ammonium salt compound be a compound of the following formula (I—A), and that the fluorine-containing iminium compound be a compound of the following formula (I—B),

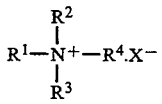

(I-A)

wherein each of $R^1$ to $R^4$ is a hydrogen atom or an organic group, at least one of $R^1$ to $R^4$ is a fluorine-containing straight chain or branched alkyl group or fluorine-containing alkenyl group having 1 to 69 carbon atoms and 3 to 66 fluorine atoms, which may contain a hydroxyl group and/or a chloromethyl group and/or a carboxylic acid amide group and/or a sulfonic acid amide group and/or a urethane group and/or an amino group and/or a $R^5$—O—$R^6$ group and/or a $R^7$—CO—O—$R^8$ group, in which $R^5$, $R^6$, $R^7$, and $R^8$ are an alkyl group having 1 to 30 carbon atoms, at most three of $R^1$ to $R^4$ are independently a straight-chain or branched alkyl group having 1 to 30 carbon atoms, an alkenyl group, an aryl group, an arylalkyl group, which aryl group and arylalkyl group may be substituted with an alkyl group having 1 to 30 carbon atoms, an alkoxyl group having 1 to 30 carbon atoms, a hydroxyl group, or a halogen atom, it being possible for two of $R^1$ to $R^4$ to join together to form a mononuclear or polynuclear ring system containing 4 to 12 carbon atoms, which may be interrupted by 1 to 4 carbon atoms and may contain 0 to 6 double bonds and also be substituted with a substituent selected from the group consisting of a fluorine atom, a chlorine atom, a bromine atom, an iodine atom, an alkyl group having 1 to 6 carbon atoms, an alkoxyl group having 1 to 6 carbon atoms, a nitro group, and an amino group; and $X^-$ is an organic or inorganic anion;

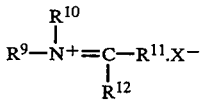

(I-B)

wherein each of $R^9$ to $R^{12}$ is a hydrogen atom or an organic group, at least one of $R^9$ to $R^{12}$ is a fluorine-containing straight-chain or branched alkyl group or fluorine-containing alkenyl group having 1 to 69 carbon atoms and 3 to 66 fluorine atoms, which may contain a hydroxyl group and/or a chloromethyl group and/or a carboxylic acid amide group and/or a sulfonic acid amide group and/or a urethane group and/or an amino group and/or a $R^5$—O—$R^6$ group and/or a $R^7$—CO—O—$R^8$ group, in which $R^5$, $R^6$, $R^7$, and $R^8$ are an alkyl group having 1 to 30 carbon atoms, at most three of $R^9$ to $R^{12}$ are independently a straight-chain or branched alkyl group having 1 to 30 carbon atoms, an alkenyl group, an aryl group or an arylalkyl group, which aryl group and arylalkyl group may be substituted with an alkyl group having 1 to 30 carbon atoms, an alkoxyl group having 1 to 30 carbon atoms, a hydroxyl group, or a halogen atom, it being possible for two of $R^9$ to $R^{12}$ to join together to form a mononuclear or polynuclear ring system containing 4 to 12 carbon atoms, which may be interrupted by 1 to 4 hetero atoms such as nitrogen, oxygen or sulfur atoms and may contain 0 to 6 double bonds and also be substituted with a substituent selected from the group consisting of a fluorine atom, a chlorine atom, a bromine atom, an iodine atom, an alkyl group having 1 to 6 carbon atoms, an alkoxyl group having 1 to 6 carbon atoms, a nitro group, and an amino group; and $X^-$ is an organic or inorganic anion; and that the aromatic hydroxycarboxylic acid metallic salt be a compound of formula (II):

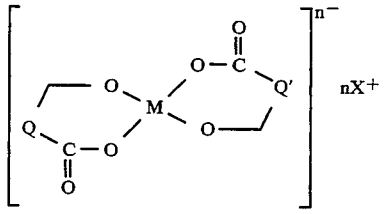

wherein Q and Q' are an aromatic oxycarboxylic acid moiety which may be substituted with an alkyl group and/or an aralkyl group; X is a counter ion; and M is a metal.

By combining the above toner particles with carrier particles coated with silicone resin or a fluorine-containing acrylic resin, there can be obtained a two-component developer which is stable in properties and capable of providing high quality images even when continuously used for an extended period of time, with excellent initial charge-rising performance, and with the triboelectric charging performance between the toner particles and the carrier particles being not affected by the changes in the ambient temperature and humidity.

DESCRIPTION OF THE PREFERRED EMBODIMENTS

Specific examples of the anion $X^-$ in the formulae (I—A) and (I—B) include $Cl^-$, $Br^-$, $I^-$, $PF_6^-$, sulfato, cyanato, thiocyanato, phosphato, $BF_4^-$, $B(aryl)_4$ such as tetraphenylborato, p-chlorotetraphenylborato, p-methylteraphenylborato, phenolato, nitrophenolato, zinc tetracyanato, zinc teterathiocyanato, saturated or unsaturated aliphatic or aromatic carboxylato or sulfonato, perfluoronated saturated or unsaturated aliphatic or perfluoronated aromatic carboxylato or sulfonato.

Of the above given anions, an anion represented by $B(phenyl)_4^-$ is preferable in view of the water resistance of the fluorine-containing compounds.

Specific examples of the fluorine-containing quaternary ammonium salt compound of the above-mentioned formula (I—A) and the fluorine-containing iminium compound of the above-mentioned formula (I—B) for use in the present invention are shown in the following Table 1:

TABLE 1

| | | |
|---|---|---|
| 1-1 | $C_8F_{17}-CH_2-CH_2-N^+$ 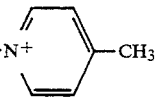 $-CH_3$ | $B(phenyl)_4^-$ |
| 1-2 | $Rf-CF=CH-CH_2-N^+(C_2H_5)_2-CH_3$ | $CH_3OSO_3^-$ Rf = $C_5F_{11}$-$C_{11}F_{23}$ |
| 1-3 | $Rf-CF=CH-CH_2-N^+(C_2H_5)_2-CH_3$ | $BF_4^-$ Rf = $C_5F_{11}$-$C_{11}F_{23}$ |
| 1-4 | $C_8F_{17}-CH_2-CH_2-N^+$ 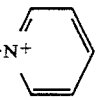 | $B(phenyl)_4^-$ |
| 1-5 | $C_8F_{17}-CH_2-CH_2-N^+$ 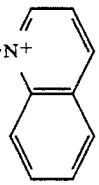 | $B(phenyl)_4^-$ |
| 1-6 | $Rf-CF=CH-CH-N^+(C_2H_5)_2-CH_3$ | $B(phenyl)_4^-$ Rf = $C_5F_{11}$-$C_{11}F_{23}$ |

In the aromatic hydroxycarboxylic acid metallic salt of formula (II), specific examples of the aromatic hydroxycarboxylic acid which is substituted with an alkyl group and/or an aralkyl group include salicylic acid, alkyl($C_1$–$C_{12}$) salicylic acid, 3,5-dialkyl($C_1$–$C_{12}$) salicylic acid, 1-hydroxy-2-naphthoic acid, 2-hydroxy-3-naphthoic acid, 2-hydroxy-1-naphthoic acid, alkyl($C_3$–$C_{12}$)-hydroxy-3-naphthoic acid, and 6-(α-methylbenzyl)-2-hydroxy-3-naphthoic acid.

Examples of the metal in the aromatic hydroxycarboxylic acid metallic salt of formula (II) include Zn, Cr, Co and Al. Depending upon the valence of the metal, a counter ion is included in the aromatic hydroxycarboxylic acid metallic salt of formula (II). Such a counter ion can be altered by treating the aromatic hydroxycarboxylic acid metallic salt after the production thereof. For instance, when the pH of the solution of the product is set at 3 or less before the filtration thereof, and the product is washed until the pH of the solution thereof becomes about 6 to 7 after the filtration of the product, the counter ion is a hydrogen ion, while when the pH of the solution of the product is set in a neutral to alkaline range, the counter ion is an alkaline metal ion. Furthermore, varieties of ammonium salts can be obtained by treating various hydrochloric acid salts of amines.

Specific examples of the aromatic hydroxycarboxylic acid metallic salt of formula (II) for use in the present invention are shown in the following TABLE 2:

TABLE 2

2-1

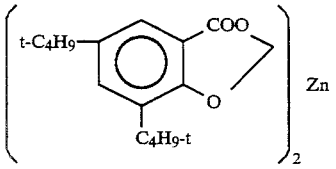

2-2

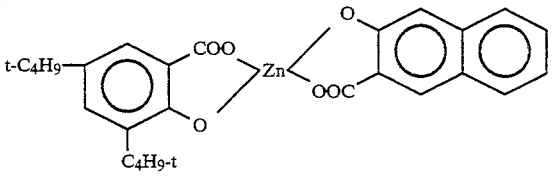

2-3

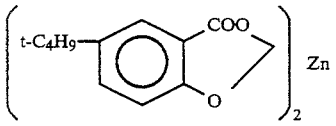

2-4

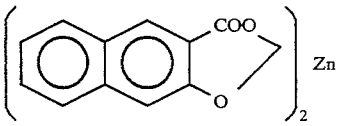

2-5

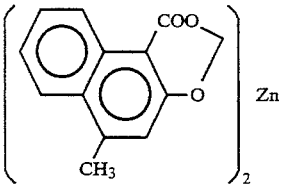

2-6

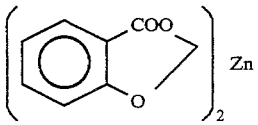

2-7

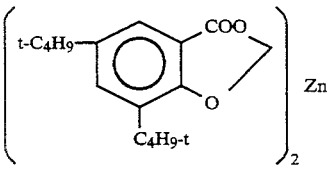

2-8

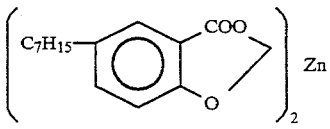

TABLE 2-continued
2-9
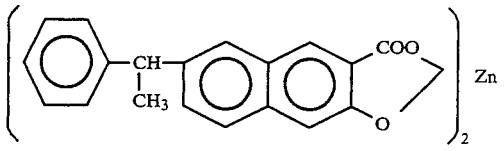
2-10
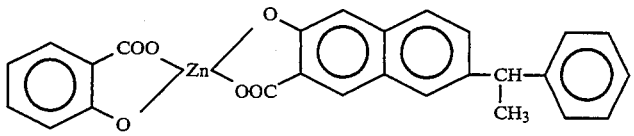
2-11
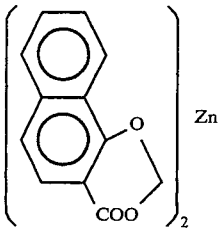
2-12
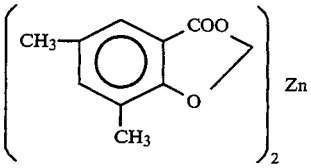
2-13
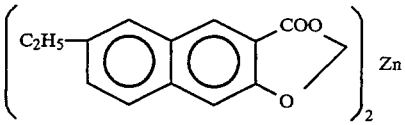
2-14
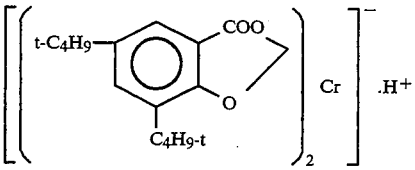
2-15
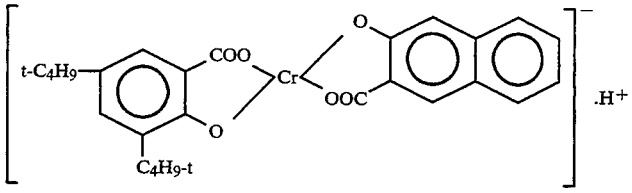
2-16
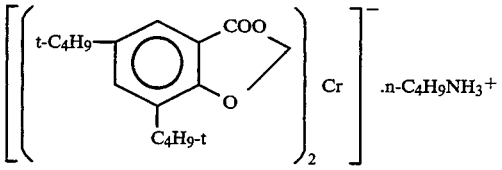
2-17
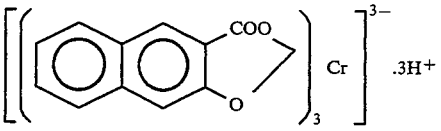
2-18
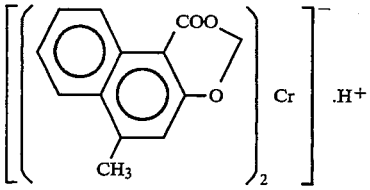
2-19
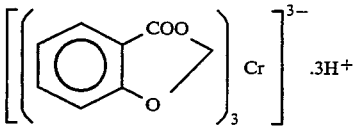
2-20
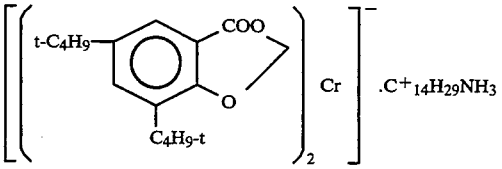
2-21
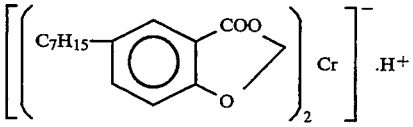

TABLE 2-continued
2-22
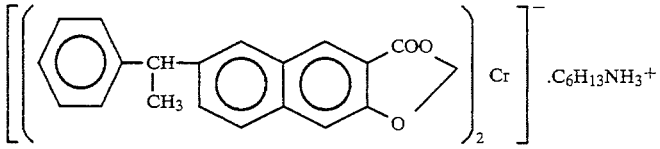
2-23
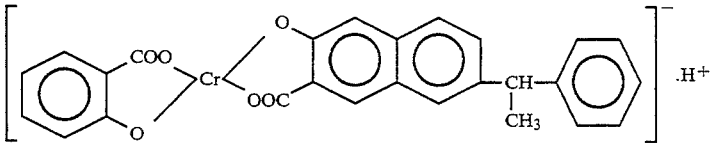
2-24
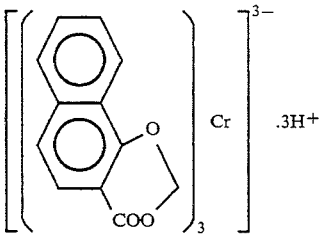
2-25
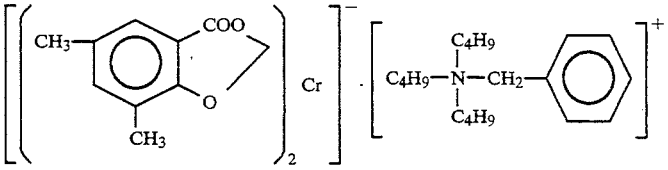
2-26
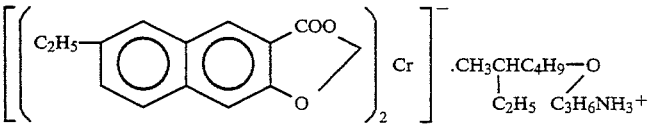
2-27
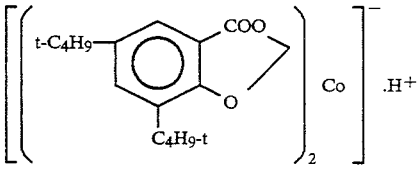
2-28
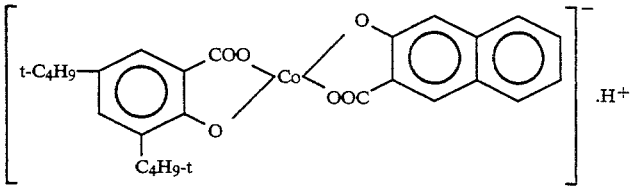
2-29
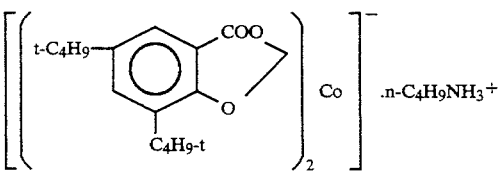
2-30
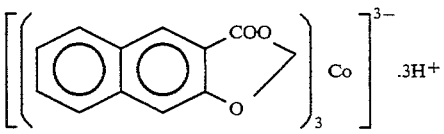

TABLE 2-continued
2-31
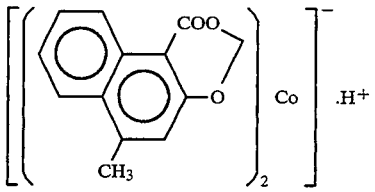
2-32
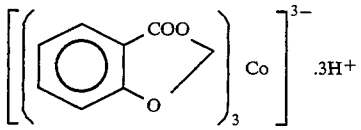
2-33
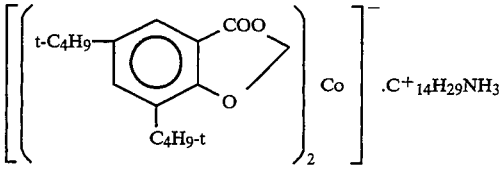
2-34
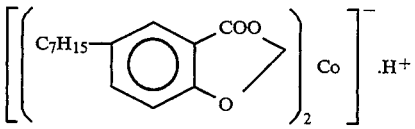
2-35
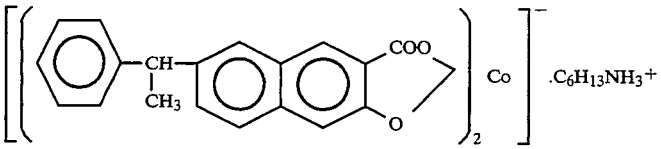
2-36
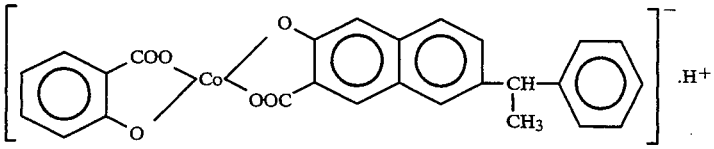
2-37
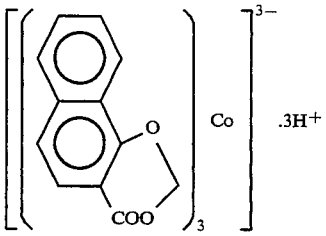
2-38
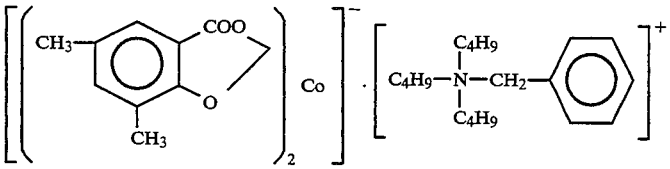
2-39
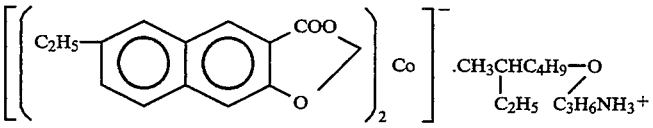
2-40
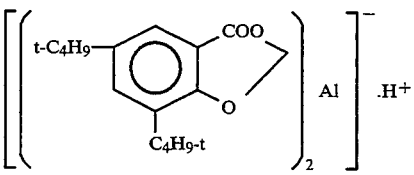

TABLE 2-continued
2-41
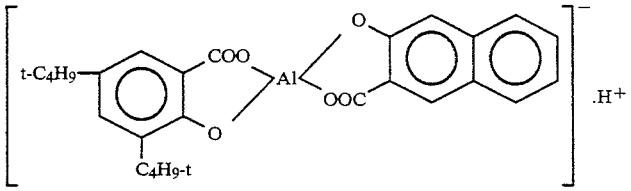
2-42
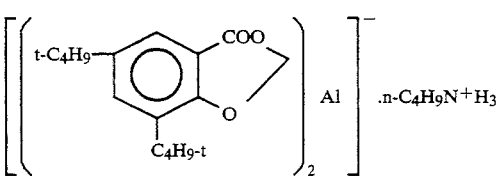
2-43
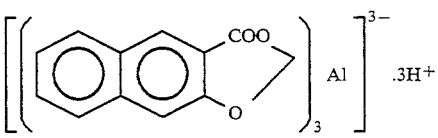
2-44
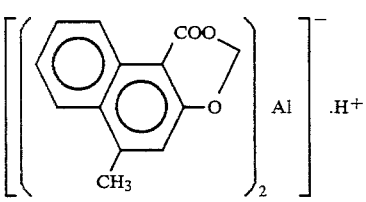
2-45
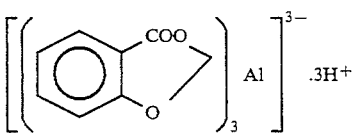
2-46
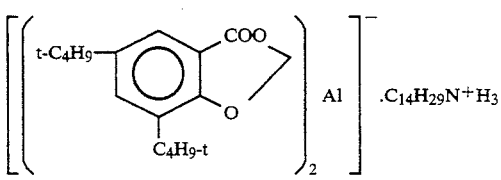
2-47
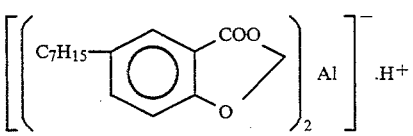
2-48
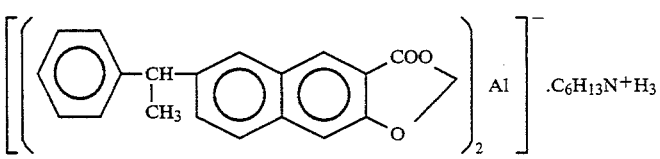
2-49
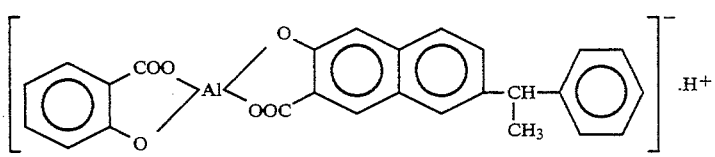
2-50
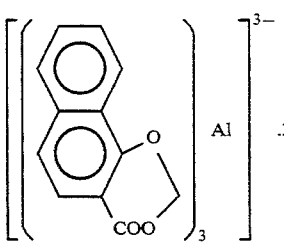
2-51
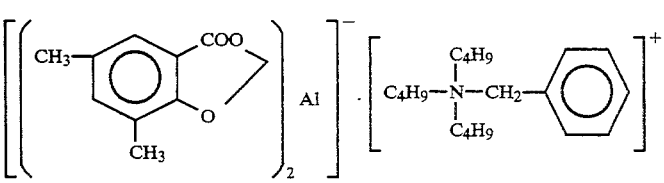

TABLE 2-continued 2-52

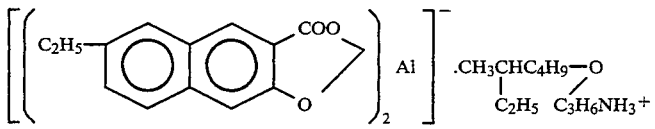

The amount of the polarity controlling agent employed in the present invention depends upon the kind of a binder resin to be employed together with the polarity controlling agent, the use or non-use of an additive, and the method of producing the toner, including a method of dispersing the components of the toner. However, it is preferable that the polarity controlling agent be employed in an amount in the range of 0.1 to 10 parts by weight, more preferably in the range of 0.5 to 5 parts by weight, to 100 parts by weight of a binder resin. This is because when the amount of the polarity controlling agent is less than 0.1 parts by weight, the negative charging of the toner tends to become insufficient for use in practice, while when the amount of the polarity controlling agent exceeds 10 parts by weight, the chargeability of the toner tends to become excessive, so that the magnetic attraction between the carrier and the toner is so increased that the fluidity of the developer tends to be decreased, and the image density tends to be lowered.

Conventional binder resins can be employed in the toner of the developer of the present invention.

Specific examples of such a binder resin for use in the present invention include homopolymers of styrene or substituted styrenes such as polystyrene, poly-p-chlorostyrene copolymer, and polyvinyltoluene; styrene copolymers such as styrene-p-chlorostyrene copolymer, styrene-propylene copolymer, styrene-vinyltoluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene-vinyl methyl ether copolymer, styrene-vinyl methyl ketone copolymer, styrene-butadiene copolymer, styrene-isoprene copolymer, styrene-maleic acid copolymer, and styrene-maleic acid ester copolymer; polymethyl methacrylate; polybutyl methacrylate; polyvinyl chloride; polyvinyl acetate; polyethylene; polypropylene; polyester; polyurethane; epoxy resin; polyvinyl butyral; polyacrylic resin; rosin; modified rosin; terpene resin; phenolic resin; aliphatic or aliphatic hydrocarbon resin; aromatic petroleum resin; chlorinated paraffin; and paraffin wax.

These binder resins can be used alone or in combination.

As a coloring agent for use in the present invention, any conventional dyes and pigments can be employed.

Specific examples of a black coloring agent for use in the present invention include carbon black, aniline black, furnace black, and lamp black.

Specific examples of a cyan coloring agent for use in the present invention include Phthalocyanine Blue, Methylene Blue, Victoria Blue, Methyl Violet, Aniline Blue, and Ultramarine Blue.

Specific examples of a magenta coloring agent for use in the present invention include Rhodamine 6G Lake, dimethyl quinacridone, Watching Red, Rose Bengale, Rhodamine B, and Alizarin Lake.

Specific examples of a yellow coloring agent for use in the present invention include Chrome Yellow, Benzidine Yellow, Hansa Yellow, Naphtol Yellow, Molybden Orange, Quinoline Yellow, and Tartrazine.

These coloring agents can be used alone or in combination.

Generally, such a coloring agent is employed in an amount of about 0.1 to 10 parts by weight, preferably in the range of 0.5 to 6 parts by weight, to 100 parts by weight of a binder resin component.

A magnetic material can be contained in the toner for use in the present invention, so that the toner can be used as a magnetic toner.

Specific examples of such a magnetic material for use in the toner include iron oxides such as magnetite, hematite, and ferrite; metals such as iron, cobalt, and nickel; and alloys of any of the above-mentioned metals with aluminum, cobalt, copper, lead, magnesium, tin, zinc, antimony, beryllium, bismuth, cadmium, calcium, manganese, selenium, titanium, tungsten, and vanadium; and mixtures thereof.

It is preferable that these ferromagnetic substances have an average particle size of about 0.1 to 2 $\mu$m, and be contained in the toner in an amount in the range of about 20 to 200 parts by weight, more preferably in the range of 40 to 150 parts by weight, to 100 parts by weight of the resin component of the toner.

When necessary, additives may be contained in the toner for use in the present invention.

Examples of such additives include a lubricant such as fluoroplastics and zinc stearate; and abradant such as cerium oxide, silicon carbide; a fluidity-imparting agent such as colloidal silica, titanium oxide, and aluminum oxide, a caking preventing agent; an electroconductivity-imparting agent such as carbon black and tin oxide; and an image fixing auxiliary agent such as a low molecular polyolefin.

As the material for the core particles of carrier particles for use in the present invention, for example, ferromagnetic materials such as iron, cobalt and nickel; alloys and compounds of magnetite, hematite and ferrite; and glass beads can be employed.

It is preferable that these core particles have an average particle size in the range of 10 to 1000 $\mu$m, more preferably in the range of 30 to 500 $\mu$m.

A resin with which the surface of the core particles is coated is generally used in an amount in the range of 0.1 to 10 parts, preferably in the range of 1 to 5 parts by weight, to 100 parts by weight of the core particles.

As such a resin for the coating of the core particles, conventional resins can be employed. In view of the life of the developer, however, silicone resin and a fluorine-containing acrylic resin are preferable for use in the present invention.

As such silicone resin, any conventionally known silicone resins can be employed. For example, silicone resins which are commercially available from Shin-Etsu Silicone Co., Ltd., such as KR261, KR271, KR272, KR275, KR280, KR282, KR285, KR251, KR155, KR220, KR201, KR204, KR205, KR206, SA-4, ES1001, ES1001N, ES1002T, and KR3093; and silicone resins which are commercially available from Toray Dow Corning Silicone Co., Ltd., such as SR2100, SR2101, SR2107, SR2110, SR2108, SR2109, SR2115, SR2400, SR2410, SR2411, SH805, SH806, and SH840, can be employed.

A silicone resin layer can be provided on the surface of the core particles by conventional coating methods such as a spray coating method and a dip coating method by which the surface of carrier core particles is coated with a silicone resin.

Examples of the fluorine-containing acrylic resin include conventionally known fluorinated alkylacrylate polymers and fluorinated alkylmethacrylate polymers.

Specific examples of such a fluorine-containing acrylic resin are shown in the following TABLE 3:

TABLE 3

| | |
|---|---|
| 1 | $\left(CH_2-\underset{\underset{COOCH_2CF_3}{\vert}}{\overset{\overset{CH_3}{\vert}}{C}}\right)$ |
| 2 | $\left(CH_2-\underset{\underset{COOCH_2CF_2CF_3}{\vert}}{\overset{\overset{CH_3}{\vert}}{C}}\right)$ |
| 3 | $\left(CH_2-\underset{\underset{COOCH_2CF_2CF_2H}{\vert}}{\overset{\overset{CH_3}{\vert}}{C}}\right)_{50}\left(CH_2-\underset{\underset{COOCH_3}{\vert}}{\overset{\overset{CH_3}{\vert}}{C}}\right)_{20}$ |
| 4 | $\left(CH_2-\underset{\underset{COOCH_2CF_2CF_2CF_2CF_2H}{\vert}}{\overset{\overset{CH_3}{\vert}}{C}}\right)$ |
| 5 | $\left(CH_2-\underset{\underset{COOCH_2CF_2CF_2CF_3}{\vert}}{CH}\right)_{30}\left(CH_2-\underset{\underset{C_6H_5}{\vert}}{C}\right)_{20}$ |
| 6 | $\left(CH_2-\underset{\underset{COOCH_2CF_2CF_2CF_3}{\vert}}{CH}\right)$ |
| 7 | $\left(CH_2-\underset{\underset{COOCH_2CF_2CF_2CF_2CF_2CF_2H}{\vert}}{\overset{\overset{CH_3}{\vert}}{C}}\right)$ |
| 8 | $\left(CH_2-\underset{\underset{COOCH_2CF_3CF_3}{\vert}}{\overset{\overset{CH_3}{\vert}}{C}}\right)_{30}\left(CH_2-\underset{\underset{COOCH_3}{\vert}}{\overset{\overset{CH_3}{\vert}}{C}}\right)_{20}$ |
| 9 | $\left(CH_2-\underset{\underset{COOCH_2(CF_2)_2H}{\vert}}{\overset{\overset{CH_3}{\vert}}{C}}\right)$ |
| 10 | $\left(CH_2-\underset{\underset{COOCH_2(CF_2)_4H}{\vert}}{CH}\right)_{55}$ |
| 11 | $\left(CH_2-\underset{\underset{COO(CH_2)_2(CF_2)_2H}{\vert}}{\overset{\overset{CH_3}{\vert}}{C}}\right)$ |
| 12 | $\left(CH_2-\underset{\underset{COOCH_2(CF_2)_2H}{\vert}}{CH}\right)_{40}\left(CH_2-\underset{\underset{C_6H_5}{\vert}}{C}\right)_{10}$ |
| 13 | $\left(CH_2-\underset{\underset{COOCH_2(CF_2)_4H}{\vert}}{CH}\right)_{10}\left(CH_2-\underset{\underset{COOCH_3}{\vert}}{\overset{\overset{CH_3}{\vert}}{C}}\right)_{15}$ |
| 14 | $\left(CH_2-\underset{\underset{COOCH_2(CF_2)_2H}{\vert}}{\overset{\overset{CH_3}{\vert}}{C}}\right)_{75}\left(CH_2-\underset{\underset{COOCH_3}{\vert}}{\overset{\overset{CH_3}{\vert}}{C}}\right)_{25}$ |
| 15 | $\left(CH_2-\underset{\underset{COOCH_2CF_3}{\vert}}{CH}\right)$ |
| 16 | $\left(CH_2-\underset{\underset{COOCH_2CF_2}{\vert}}{\overset{\overset{CH_3}{\vert}}{C}}\right)_{20}\left(CH_2-\underset{\underset{COOCH_3}{\vert}}{\overset{\overset{CH_3}{\vert}}{C}}\right)_{80}$ |
| 17 | $\left(CH_2-\underset{\underset{COOCH_2CF_3}{\vert}}{\overset{\overset{CH_3}{\vert}}{C}}\right)_{30}\left(CH_2-\underset{\underset{COOCH_3}{\vert}}{CH}\right)_{10}$ |
| 18 | $\left(CH_2-\underset{\underset{COOCH_2CF_2CF_3}{\vert}}{CH}\right)$ |
| 19 | $\left(CH_2-\underset{\underset{COOCH_2CF_3}{\vert}}{\overset{\overset{CH_3}{\vert}}{C}}\right)\left(CH_2-\underset{\underset{COOCH_3}{\vert}}{\overset{\overset{CH_3}{\vert}}{C}}\right)_{45}$ |
| 20 | $\left(CH_2-\underset{\underset{COOCH_2(CF_2)_2CF_3}{\vert}}{\overset{\overset{CH_3}{\vert}}{C}}\right)$ |
| 21 | $\left(CH_2-\underset{\underset{COOCH_2(CF_2)_4CF_3}{\vert}}{\overset{\overset{CH_3}{\vert}}{C}}\right)$ |
| 22 | $\left(CH_2-\underset{\underset{COOCH_2(CF_2)_{10}CF_3}{\vert}}{\overset{\overset{CH_3}{\vert}}{C}}\right)$ |
| 23 | $\left(CH_2-\underset{\underset{COOCH_2CF_3}{\vert}}{\overset{\overset{CH_3}{\vert}}{C}}\right)_{45}\left(CH_2-\underset{\underset{COOCH_3}{\vert}}{\overset{\overset{CH_3}{\vert}}{C}}\right)_{55}$ |
| 24 | $\left(CH_2-\underset{\underset{COOCH_2(CF_2)_{10}CF_3}{\vert}}{CH}\right)_{80}\left(CH_2-\underset{\underset{COOCH_3}{\vert}}{\overset{\overset{CH_3}{\vert}}{C}}\right)_{20}$ |

A fluorine-containing acrylic resin layer can be provided on the surface of the core particles in the same manner as in the case of the provision of the silicone resin layer by the conventional coating methods such as a spray coating method and a dip coating method.

When finely-divided electroconductive particles are added to the coating layer in order to improve the edge effect at the time of development by decreasing the electric resistivity of the coating layer comprising the silicone resin or the fluorine-containing acrylic resin provided on the core particles of the carrier, or when a coupling agent is added to the coating layer in order to improve the stability of the positive chargeability of the carrier or to promote the dispersion of an electroconductive agent in the resin layer, the finely-divided electroconductive particles or the coupling agent such as a silane coupling agent is dispersed together with the resin in a mixer to prepare a coating liquid for the formation of the coating layer.

It is preferable that the finely-divided electroconductive particles to be dispersed in the coating layer have a particle size in the range of about 0.14 to 5.0 μm. Furthermore, it is preferable that the amount of the finely-divided electroconductive particles to be added be in the range of 0.01 to 30 parts by weight, more preferably in the range of 0.1 to 20 parts by weight, to 100 parts by weight of the silicone resin or the fluorine-containing acrylic resin.

As the material for the finely-divided electroconductive particles, conventionally known carbon black, such as contact black, furnace black, and thermal black, can be employed.

As the silane coupling agent, a compound of formula $X—Si(OR)_3$ can be employed, in which X is a functional group which is reactive with an organic material and R is a group that can be hydrolyzed. In particular, an aminosilane coupling agent having an amino group is preferable for use in the present invention because the uniformity and stability of the dispersion of the finely-divided electroconductive particles, dispersed during the discharging of the carrier particles are prompted by the addition of the aminosilane coupling agent.

Specific examples of such an aminosilane coupling agent include γ-(2-aminoethyl)aminopropyltrimethoxysilane, γ-(2-aminoethyl)aminopropylmethyldimethoxysilane, γ-aminopropyltrimethoxysilane, and octadecyldimethyl[3-(trimethoxysilyl)propyl]ammonium chloride.

It is preferable that such a silane coupling agent be added in an amount in the range of 0.1 to 10 parts by weight, more preferably in the range of 0.2 to 5 parts by weight, to 100 parts by weight of the silicone resin or the fluorine-containing acrylic resin.

The features of this invention will become apparent in the course of the following description of exemplary embodiments, which are given for illustration of the invention and are not intended to be limiting thereof:

Toner Production Example 1

A mixture of the following components was sufficiently mixed with stirring in a Henschel mixer:

| | Parts by Weight |
|---|---|
| Polyester resin (Trademark "KTD-150" made by Kao Corporation) | 80 |
| Styrene - acrylate copolymer (Trademark "SBM100" made by Sanyo Chemical Industries, Ltd.) | 20 |
| Carbon black (Trademark "#44" made by Mitsubishi Carbon Co., Ltd.) | 8 |
| Polarity controlling agents: | |
| Fluorine-containing compound of formula 1-2 in TABLE 1 | 2 |
| Metal Salt of formula 2-14 in TABLE 2 | 2 |

The above mixture was then fused in a roll mill at 120° to 130° C. for about 30 minutes, and was then cooled to room temperature, whereby a kneaded lump was obtained. The thus obtained lump was pulverized and classified, whereby toner particles A with a particle size of 5 to 20 μm were obtained.

Toner Production Example 2

A mixture of the following components was sufficiently mixed with stirring in a Henschel mixer:

| | Parts by Weight |
|---|---|
| Polyester resin (Trademark "KTD-150" made by Kao Corporation) | 100 |
| Disaszo Yellow LG-L (C.I. Pigment Yellow 1, made by Sumika Color Color Co., Ltd.) | 5 |
| Polarity controlling agents: | |
| Fluorine-containing compound of formula 1-1 in TABLE 1 | 2 |
| Metal Salt of formula 2-1 in TABLE 2 | 2 |

The above mixture was then fused in a roll mill at 100° to 110° C. for about 30 minutes, and was then cooled to room temperature, whereby a kneaded lump was obtained. The thus obtained lump was pulverized and classified, whereby toner particles with a particle size of 5 to 20 μm were obtained.

0.5 parts by weight of a hydrophobic titanium oxide were added to 100 parts by weight of the above-obtained toner particles, and the mixture was stirred sufficiently in a Henschel Mixer, whereby toner particles B were obtained.

Toner Production Example 3

A mixture of the following components was sufficiently mixed with stirring in a Henschel mixer:

| | Parts by Weight |
|---|---|
| Epoxy resin (Trademark "YA-904" made by Tohto Kasei Co., Ltd.) | 100 |
| Phthalocyanine Blue (Trademark "Chromofine Blue KBN" made by Dainichiseika Color & Chemicals Mfg. Co., Ltd., C.I. Pigment Blue 15) | 2 |
| Polarity controlling agents: | |
| Fluorine-containing compound of formula 1-6 in TABLE 1 | 2 |
| Metal Salt of formula 2-1 in TABLE 2 | 2 |

The above mixture was then fused in a roll mill at 100° to 110° C. for about 30 minutes, and was then cooled to room temperature, whereby a kneaded lump was obtained. The thus obtained lump was pulverized and classified, whereby toner particles with a particle size of 5 to 20 μm were obtained.

0.5 parts by weight of a hydrophobic silica were added to 100 parts by weight of the above-obtained toner particles, and the mixture was stirred sufficiently in a Henschel Mixer, whereby toner particles C were obtained.

Toner Production Example 4

A mixture of the following components was sufficiently mixed with stirring in a Henschel mixer:

| | Parts by Weight |
|---|---|
| Epoxy resin (Trademark "YA-904" made by Tohto Kasei Co., Ltd.) | 100 |
| Phthalocyanine Blue (Trademark "Chromofine Blue KBN" made by Dainichiseika Color & Chemicals Mfg. Co., Ltd., C.I. Pigment Blue 15) | 2 |
| Polarity controlling agents: | |
| Fluorine-containing compound of formula 1-6 in TABLE 1 | 3 |
| Metal Salt of formula 2-27 in TABLE 2 | 1.5 |

The above mixture was then fused in a roll mill at 100° to 110° C. for about 30 minutes, and was then cooled to room temperature, whereby a kneaded lump was obtained. The thus obtained lump was pulverized and classified, whereby toner particles with a particle size of 5 to 20 μm were obtained.

0.5 parts by weight of a hydrophobic silica were added to 100 parts by weight of the above-obtained toner particles, and the mixture was stirred sufficiently in a Henschel Mixer, whereby toner particles D were obtained.

Toner Production Example 5

A mixture of the following components was sufficiently mixed with stirring in a Henschel mixer:

| | Parts by Weight |
|---|---|
| Epoxy resin (Trademark "YA-904" made by Tohto Kasei Co., Ltd.) | 100 |
| Phthalocyanine Blue (Trademark "Chromofine Blue KBN" made by Dainichiseika Color & Chemicals Mfg. Co., Ltd., C.I. Pigment Blue 15) | 2 |
| Polarity controlling agents: | |
| Fluorine-containing compound of formula 1-6 in TABLE 1 | 1 |
| Metal Salt of formula 2-1 in TABLE 2 | 0.5 |

The above mixture was then fused in a roll mill at 100° to 110° C. for about 30 minutes, and was then cooled to room temperature, whereby a kneaded lump was obtained. The thus obtained lump was pulverized and classified, whereby toner particles with a particle size of 5 to 20 μm were obtained.

0.5 parts by weight of a hydrophobic silica were added to 100 parts by weight of the above-obtained toner particles, and the mixture was stirred sufficiently in a Henschel Mixer, whereby toner particles E were obtained.

Toner Production Example 6

A mixture of the following components was sufficiently mixed with stirring in a Henschel mixer:

| | Parts by Weight |
|---|---|
| Styrene - acrylate copolymer (Trademark "SBM100" made by Sanyo Chemical Industries, Ltd.) | 100 |
| Carbon black (Trademark "#44" made by Mitsubishi Carbon Co., Ltd.) | 8 |
| Polarity controlling agents | |
| Fluorine-containing compound of formula 1-6 in TABLE 1 | 2 |
| Metal Salt of formula 2-1 in TABLE 2 | 1 |

The above mixture was then fused in a roll mill at 120° to 130° C. for about 30 minutes, and was then cooled to room temperature, whereby a kneaded lump was obtained. The thus obtained lump was pulverized and classified, whereby toner particles with a particle size of 5 to 20 μm were obtained.

0.5 parts by weight of a hydrophobic aluminum oxide were added to 100 parts by weight of the above-obtained toner particles, and the mixture was stirred sufficiently in a Henschel Mixer, whereby toner particles F were obtained.

Toner Production Example 7

A mixture of the following components was sufficiently mixed with stirring in a Henschel mixer:

| | Parts by Weight |
|---|---|
| Styrene - acrylate copolymer (Trademark "SBM100" made by Sanyo Chemical Industries, Ltd.) | 100 |
| Carbon black (Trademark "#44" made by Mitsubishi Carbon Co., Ltd.) | 8 |
| Polarity controlling agents | |
| Fluorine-containing compound of formula 1-6 in TABLE 1 | 1 |
| Metal Salt of formula 2-14 in TABLE 2 | 1.5 |

The above mixture was then fused in a roll mill at 120° to 130° C. for about 30 minutes, and was then cooled to room temperature, whereby a kneaded lump was obtained. The thus obtained lump was pulverized and classified, whereby toner particles with a particle size of 5 to 20 μm were obtained.

0.5 parts by weight of a hydrophobic aluminum oxide were added to 100 parts by weight of the above-obtained toner particles, and the mixture was stirred sufficiently in a Henschel Mixer, whereby toner particles G were obtained.

Toner Production Example 8

A mixture of the following components was sufficiently mixed with stirring in a Henschel mixer:

| | |
|---|---|
| Styrene - acrylate copolymer (Trademark "SBM100" made by Sanyo Chemical Industries, Ltd.) | 100 |
| Carbon black (Trademark , "#44" made by Mitsubishi Carbon Co., Ltd.) | 8 |
| Polarity controlling agents | |
| Fluorine-containing compound of formula 1-1 in TABLE 1 | 1 |

-continued

| | |
|---|---|
| Metal Salt of formula 2-2 in TABLE 2 | 1.5 |

The above mixture was then fused in a roll mill at 120° to 130° C. for about 30 minutes, and was then cooled to room temperature, whereby a kneaded lump was obtained. The thus obtained lump was pulverized and classified, whereby toner particles with a particle size of 5 to 20 μm were obtained.

0.5 parts by weight of a hydrophobic aluminum oxide were added to 100 parts by weight of the above-obtained toner particles, and the mixture was stirred sufficiently in a Henschel Mixer, whereby toner particles H were obtained.

Toner Production Example 9

A mixture of the following components was sufficiently mixed with stirring in a Henschel mixer:

| | Parts by Weight |
|---|---|
| Styrene - acrylate copolymer (Trademark "SBM100" made by Sanyo Chemical Industries, Ltd.) | 100 |
| Carbon black (Trademark "#44" made by Mitsubishi Carbon Co., Ltd.) | 8 |
| Polarity controlling agents | |
| Fluorine-containing compound of formula 1-3 in TABLE 1 | 3 |
| Metal Salt of formula 2-27 in TABLE 2 | 0.5 |

The above mixture was then fused in a roll mill at 120° to 130° C. for about 30 minutes, and was then cooled to room temperature, whereby a kneaded lump was obtained. The thus obtained lump was pulverized and classified, whereby toner particles with a particle size of 5 to 20 μm were obtained.

0.5 parts by weight of a hydrophobic aluminum oxide were added to 100 parts by weight of the above-obtained toner particles, and the mixture was stirred sufficiently in a Henschel Mixer, whereby toner particles I were obtained.

Comparative Toner Production Example 1

A mixture of the following components was sufficiently mixed with stirring in a Henschel mixer:

| | Parts by Weight |
|---|---|
| Polyester resin (Trademark "KTD-150", made by Kao Corporation) | 80 |
| Styrene - acrylate copolymer (Trademark "SBM100" made by Sanyo Chemical Industries, Ltd.) | 20 |
| Carbon black (Trademark "#44" made by Mitsubishi Carbon Co., Ltd.) | 8 |
| Polarity controlling agent: | |
| Fluorine-containing compound of formula 1-1 in TABLE 1 | 2 |

The above mixture was then fused in a roll mill at 120° to 130° C. for about 30 minutes, and was then cooled to room temperature, whereby a kneaded lump was obtained. The thus obtained lump was pulverized and classified, whereby toner particles J with a particle size of 5 to 20 μm were obtained.

Comparative Toner Production Example 2

A mixture of the following components was sufficiently mixed with stirring in a Henschel mixer:

| | Parts by Weight |
|---|---|
| Polyester resin (Trademark "KTD-150" made by Kao Corporation) | 100 |
| Disaszo Yellow LG-L (C.I. Pigment Yellow 12, made by Sumika Color Color Co., Ltd.) | 5 |
| Polarity controlling agent: Metal Salt of formula 2-14 in TABLE 2 | 2 |

The above mixture was then fused in a roll mill at 100° to 110° C. for about 30 minutes, and was then cooled to room temperature, whereby a kneaded lump was obtained. The thus obtained lump was pulverized and classified, whereby toner particles K with a particle size of 5 to 20 μm were obtained.

Carrier Production Example 1

A mixture of the following components was dispersed in a homomixer for 30 minutes, whereby a coating layer formation liquid was prepared:

| | Parts by Weight |
|---|---|
| Fluorine-containing acrylic resin 8 in TABLE 3 | 50 |
| Acetone/methyl ethyl ketone | 500 |

The surface of spherical ferrite particles with an average particle size of 50 μm in an amount of 1000 parts by weight was coated with the above prepared coating layer formation liquid by use of a fluidized bed type coating apparatus, whereby a coated carrier A was obtained.

Carrier Production Example 2

A mixture of the following components was dispersed in a homomixer for 30 minutes, whereby a coating layer formation liquid was prepared:

| | Parts by Weight |
|---|---|
| Vinylidene fluoride/ethylene tetrafluoride (60:40) copolymer | 20 |
| Fluorine-containing acrylic resin 14 in TABLE 3 | 30 |
| Acetone/methyl ethyl ketone | 500 |

The surface of spherical ferrite particles with an average particle size of 60 μm in an amount of 1000 parts by weight was coated with the above prepared coating layer formation liquid by use of a fluidized bed type coating apparatus, whereby a coated carrier B was obtained.

Carrier Production Example 3

A mixture of the following components was dispersed in a homomixer for 30 minutes, whereby a coating layer formation liquid was prepared:

| | Parts by Weight |
|---|---|
| Carbon black (Trademark "C600" made by Lion Akzo Co., Ltd.) | 2 |
| Fluorine-containing acrylic resin 3 in TABLE 3 | 50 |
| Acetone/methyl ethyl ketone | 500 |

The surface of spherical ferrite particles with an average particle size of 50 μm in an amount of 1000 parts by weight was coated with the above prepared coating layer formation liquid by use of a fluidized bed type coating apparatus, whereby a coated carrier C was obtained.

Comparative Carrier Production Example 1

A mixture of the following components was dispersed in a homomixer for 30 minutes, whereby a coating layer formation liquid was prepared:

| | Parts by Weight |
|---|---|
| St - MMA (90:10) copolymer (Trademark "BR-60" made by Mitsubishi Rayon Co., Ltd.) | 40 |
| Toluene | 400 |

The surface of spherical ferrite particles with an average particle size of 60 μm in an amount of 1000 parts by weight was coated with the above prepared coating layer formation liquid by use of a fluidized bed type coating apparatus, whereby a coated carrier D was obtained.

Carrier Production Example 4

A mixture of the following components was dispersed in a homomixer for 30 minutes, whereby a coating layer formation liquid was prepared:

| | Parts by Weight |
|---|---|
| Silicone resin solution (Trademark "SR411" made by Toray Dow Corning Co., Ltd.) | 100 |
| Toluene | 100 |

The surface of spherical ferrite particles with an average particle size of 50 μm in an amount of 1000 parts by weight was coated with the above prepared coating layer formation liquid by use of a fluidized bed type coating apparatus, whereby a coated carrier E was obtained.

Carrier Production Example 5

A mixture of the following components was dispersed in a homomixer for 30 minutes, whereby a coating layer formation liquid was prepared:

| | Parts by Weight |
|---|---|
| Silicone resin solution (Trademark "KR50" made by Shin-Etsu Chemical Co., Ltd.) | 100 |
| Aminosilane coupling agents: γ-(2-aminoethyl)aminopropyl-trimethoxysilane | 1 |
| Toluene | 100 |

The surface of spherical ferrite particles with an average particle size of 60 μm in an amount of 1000 parts by weight was coated with the above prepared coating layer formation liquid by use of a fluidized bed type coating apparatus, whereby a coated carrier F was obtained.

Carrier Production Example 6

A mixture of the following components was dispersed in a homomixer for 30 minutes, whereby a coating layer formation liquid was prepared:

| | Parts by Weight |
|---|---|
| Silicone resin solution (Trademark "SR410" made by Toray Dow Corning Co., Ltd.) | 100 |
| Carbon black (Trademark "C600" made by Lion Akzo Co., Ltd.) | 3 |
| Aminosilane coupling agent: γ-(2-aminoethyl)aminopropyl-trimethoxysilane | 1 |
| Toluene | 100 |

The surface of spherical ferrite particles with an average particle size of 50 μm in an amount of 1000 parts by weight was coated with the above prepared coating layer formation liquid by use of a fluidized bed type coating apparatus, whereby a coated carrier G was obtained.

Carrier Production Example 7

A mixture of the following components was dispersed in a homomixer for 30 minutes, whereby a coating layer formation liquid was prepared:

| | Parts by Weight |
|---|---|
| Silicone resin solution (Trademark "KR50" made by Shin-Etsu Chemical Co., Ltd.) | 100 |
| Carbon black (Trademark "BP2000" made by Cabot Corp.) | 3 |
| Toluene | 100 |

The surface of spherical ferrite particles with an average particle size of 50 μm in an amount of 1000 parts by weight was coated with the above prepared coating layer formation liquid by use of a fluidized bed type coating apparatus, whereby a coated carrier H was obtained.

4 parts by weight of each of the toners prepared in Toner Production Examples 1 to 9 and Comparative Toner Production Examples 1 to 3, and 96 parts by weight of each of the carriers prepared in Carrier Production Examples 1 to 7 and Comparative Carrier Production Example 1 were combined to prepare two-component developers.

Each of the developers was incorporated in a modified commercially available copying machine (Trademark "IMAGIO-320" made by Ricoh Company, Ltd.) and development tests were conducted.

The charge quantity of each toner was measured at the time of making a first copy and that after making 100,000 copies.

Furthermore, the charge quantity of each toner under high temperature and high humidity conditions, specifically at 35° C., 90% RH, which is referred to as HG, and that of each toner under low temperature and low humidity conditions, specifically at 10° C., 15% RH, which is referred to LG, were measured, and the stability of each toner against changes in the ambient conditions, which is referred to as the environmental stability, was assessed and evaluated in accordance with the following formula:

$$\text{Environmental Stability (\%)} = \frac{LG - HG}{LG} \times 100$$

◎: 0–5%,
○: 5–10%
Δ: 10–30%,
X: more than 30%

Furthermore, each toner and each carrier were mixed for 1 minute, and then for 10 minutes, and the charge-rising performance of each toner was evaluated in accordance with the following formula:

$$\frac{\text{Charge Quantity for 1 minute}}{\text{Charge Quantity for 10 minutes}} \times 100$$

○: not less than 60
X: less than 60

The results of the above-mentioned measurements and evaluation are shown in the following TABLE 4:

TABLE 4

| Examples | Toner | Carrier | Charge Quantity (-μC/G) Initial | After making $10^5$ copies | Environmental Stability | Charge-rising Performance |
|---|---|---|---|---|---|---|
| Ex. 1 | A | A | 16.2 | 15.8 | ○ | ○ |
| Ex. 2 | B | A | 18.8 | 17.7 | ◎ | ○ |
| Ex. 3 | C | A | 17.5 | 16.9 | ◎ | ○ |
| Ex. 4 | D | A | 14.3 | 13.9 | ◎ | ○ |
| Ex. 5 | E | A | 14.8 | 12.8 | ◎ | ○ |
| Ex. 6 | F | A | 15.6 | 15.2 | ◎ | ○ |
| Ex. 7 | G | A | 14.6 | 14.3 | ◎ | ○ |
| Ex. 8 | H | A | 19.5 | 18.6 | ◎ | ○ |
| EX. 9 | I | A | 16.5 | 15.9 | ○ | ○ |
| Ex. 10 | A | G | 21.2 | 22.5 | ○ | ○ |
| Ex. 11 | B | G | 22.6 | 24.0 | ◎ | ○ |
| Ex. 12 | C | G | 18.8 | 18.5 | ◎ | ○ |
| Ex. 13 | D | G | 17.5 | 16.4 | ◎ | ○ |
| Ex. 14 | E | G | 22.4 | 21.5 | ◎ | ○ |
| Ex. 15 | F | G | 19.2 | 18.8 | ◎ | ○ |
| Ex. 16 | G | G | 20.3 | 19.6 | ◎ | ○ |
| Ex. 17 | H | G | 17.6 | 16.8 | ◎ | ○ |
| Ex. 18 | I | G | 18.8 | 20.2 | ○ | ○ |
| Ex. 19 | C | B | 17.5 | 18.1 | ◎ | ○ |
| Ex. 20 | C | C | 16.8 | 15.5 | ◎ | ○ |
| Ex. 21 | C | D | 24.5 | 11.3 | ◎ | ○ |
| Ex. 22 | C | E | 16.6 | 16.9 | ◎ | ○ |
| Ex. 23 | C | F | 17.2 | 17.5 | ◎ | ○ |
| Ex. 24 | C | H | 15.8 | 15.3 | ◎ | ○ |
| Ex. 25 | C | I | 19.3 | 21.2 | ◎ | ○ |
| Comp. Ex. 1 | J | A | 14.3 | 9.8 | ◎ | X |
| Comp. Ex. 2 | K | A | 26.6 | 34.3 | X | ○ |
| Comp. Ex. 3 | J | G | 15.3 | 11.6 | ◎ | X |
| Comp. Ex. 4 | K | G | 28.1 | 36.0 | X | ○ |
| Comp. Ex. 5 | C | Without Coating | 27.7 | 9.8 | X | X |

According to the present invention, a developer capable of developing latent electrostatic images in a stable manner without being affected by the ambient conditions thereof such as temperature and humidity can be provided.

Also the present invention can provide a two-component developer which is capable of providing developed images with high quality and faithfulness throughout a development process, with a high charge-rising performance, and has a stable triboelectric chargeability between toner particles and carrier particles, without causing the deposition of toner particles on the background of developed images and the scattering of the toner particles even when used continuously for an extended period of time.

Furthermore, according to the present invention, there can be obtained a two-component color developer which is capable of providing uniform and high quality images free from edge effect, without the deterioration of color development performance even when used for an extended period of time.

Japanese Patent Application 5-096778 filed Mar. 31, 1993 is hereby incorporated by reference.

What is claimed is:

1. A developer which comprise toner particles, said toner particles comprising:

a thermoplastic resin;

a coloring agent;

one component selected from the group consisting of a fluorine-containing quaternary ammonium salt compound and a fluorine-containing iminium compound; and an aromatic hydroxycarboxylic acid metallic salt.

2. The developer as claimed in claim 1, wherein said fluorine-containing quaternary ammonium salt compound is a compound of formula (I—A):

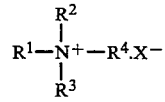

(I-A)

wherein each of $R^1$ to $R^4$ is a hydrogen atom or an organic group, at least one of $R^1$ to $R^4$ is a fluorine-containing straight chain or branched alkyl group or fluorine-containing alkenyl group having 1 to 69 carbon atoms and 3 to 66 fluorine atoms, which may contain a hydroxyl group and/or a chloromethyl group and/or a carboxylic acid amide group and/or a sulfonic acid amide group and/or a urethane group and/or an amino group and/or a $R^5$—O—$R^6$ group and/or a $R^7$—CO—O—$R^8$ group, in which $R^5$, $R^6$, $R^7$, and $R^8$ are an alkyl group having 1 to 30 carbon atoms, at most three of $R^1$ to $R^4$ are independently a straight-chain or branched alkyl group having 1 to 30 carbon atoms, an alkenyl group, an aryl group, an arylalkyl group, which aryl group and arylalkyl group may be substituted with an alkyl group having 1 to 30 carbon atoms, an alkoxyl group having 1 to 30 carbon atoms, a hydroxyl group, or a halogen atom, it being possible for two of $R^1$ to $R^4$ to join together to form a mononuclear or polynuclear ring system containing 4 to 12 carbon atoms, which may be interrupted by 1 to 4 carbon atoms and may contain 0 to 6 double bonds and also be substituted with a substituent selected from the group consisting of a fluorine atom, a chlorine atom, a bromine atom, an iodine atom, an alkyl group having 1 to 6 carbon atoms, an alkoxyl group having 1 to 6 carbon atoms, a nitro group, and an amino group; and $X^-$ is an organic or inorganic anion.

3. The developer as claimed in claim 1, wherein said fluorine-containing iminium compound is a compound of formula (I—B):

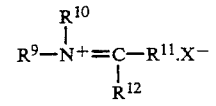

(I-B)

wherein each of $R^9$ to $R^{12}$ is a hydrogen atom or an organic group, at least one of $R^9$ to $R^{12}$ is a fluorine-containing straight-chain or branched alkyl group or fluorine-containing alkenyl group having 1 to 69 carbon atoms and 3 to 66 fluorine atoms, which may contain a hydroxyl group and/or a chloromethyl group and/or a carboxylic acid amide group and/or a sulfonic acid amide group and/or a urethane group and/or an amino group and/or a $R^5$—O—$R^6$ group and/or a $R^7$—CO—O—$R^8$ group, in which $R^5$, $R^6$, $R^7$, and $R^8$ are an alkyl group having 1 to 30 carbon atoms, at most three of $R^9$ to $R^{12}$ are independently a straight-chain or branched alkyl group having 1 to 30 carbon atoms, an alkenyl group, an aryl group or an arylalkyl group, which aryl group and arylalkyl group may be substituted with an alkyl group having 1 to 30 carbon atoms, an alkoxyl group having 1 to 30 carbon atoms, a hydroxyl group, or a halogen atom, it being possible for two of $R^9$ to $R^{12}$ to join together to form a mononuclear or polynuclear ring system containing 4 to 12 carbon atoms, which may be interrupted by 1 to 4 hetero atoms and may contain 0 to 6 double bonds and also be substituted with a substituent selected from the group consisting of a fluorine atom, a chlorine atom, a bromine atom, an iodine atom, an alkyl group having 1 to 6 carbon atoms, an alkoxyl group having 1 to 6 carbon atoms, a nitro group, and an amino group; and $X^-$ is an organic or inorganic anion.

4. The developer as claimed in claim 1, wherein said aromatic hydroxycarboxylic acid metallic salt is a compound of formula (II):

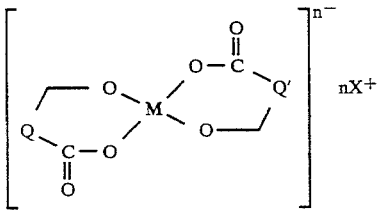

wherein Q and Q' are an aromatic oxycarboxylic acid moiety which may be substituted with an alkyl group and/or an aralkyl group; X is a counter ion; and M is a metal.

5. The developer as claimed in claim 2, wherein said anion represented by $X^-$ in said fluorine-containing quaternary ammonium salt compound of formula (I—A) is $B(phenyl)_4^-$.

6. The developer as claimed in claim 3, wherein said anion represented by $X^-$ in said fluorine-containing iminium compound of formula (I—B) is $B(phenyl)_4^-$.

7. The developer as claimed in claim 1, further comprising carrier particles.

8. The developer as claimed in claim 7, wherein the surface of said carrier particles is coated with a coating layer comprising a silicone resin.

9. The developer as claimed in claim 7, wherein the surface of said carrier particles is coated with a coating layer comprising a fluorine-containing acrylic resin.

10. The developer as claimed in claim 8, wherein said coating layer further comprises an amionosilane coupling agent which contains at least one of a primary amino group or a secondary amino group.

11. The developer as claimed in claim 9, wherein said coating layer further comprises an amionosilane coupling agent which contains at least one of a primary amino group or a secondary amino group.

12. The developer as claimed in claim 8, wherein said coating layer further comprises finely-divided electroconductive particles.

13. The developer as claimed in claim 9, wherein said coating layer further comprises finely-divided electroconductive particles.

14. The developer as claimed in claim 12, wherein said finely-divided electroconductive particles are particles of carbon black.

15. The developer as claimed in claim 13, wherein said finely-divided electroconductive particles are particles of carbon black.

16. The developer as claimed in claim 2, wherein said aromatic hydroxycarboxylic acid metallic salt is a compound of formula (II):

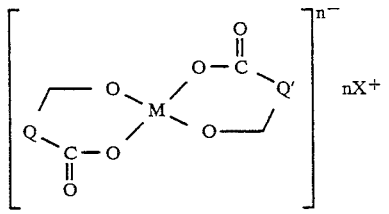

wherein Q and Q' are an aromatic oxycarboxylic acid moiety which may be substituted with an alkyl group and/or an aralkyl group; X is a counter ion; and M is a metal.

17. The developer as claimed in claim 3, wherein said aromatic hydroxycarboxylic acid metallic salt is a compound of formula (II):

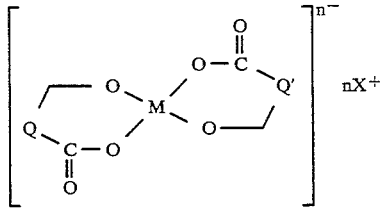

wherein Q and Q' are an aromatic oxycarboxylic acid moiety which may be substituted with an alkyl group and/or an aralkyl group; X is a counter ion; and M is a metal.

* * * * *